US006619885B2

(12) United States Patent
Pertoldi

(10) Patent No.: US 6,619,885 B2
(45) Date of Patent: Sep. 16, 2003

(54) TELESCOPIC TUNNEL FORM

(75) Inventor: Fabrice Pertoldi, Willems (FR)

(73) Assignee: Outinord St. Amand, S.A., St. Amand les Eaux (FR)

( * ) Notice: Subject to any disclaimer, the term of this patent is extended or adjusted under 35 U.S.C. 154(b) by 0 days.

(21) Appl. No.: 09/957,668

(22) Filed: Sep. 21, 2001

(65) Prior Publication Data

US 2003/0056463 A1 Mar. 27, 2003

(51) Int. Cl.[7] ..... E02D 29/00; E21D 11/00; E21D 9/00

(52) U.S. Cl. ..... 405/149; 52/741.13; 249/10; 249/11; 405/132; 405/150.2; 405/150.1

(58) Field of Search ..... 52/741.13, 745.07; 249/10, 11, 12; 405/132, 149, 150.1, 150.2

(56) References Cited

U.S. PATENT DOCUMENTS

| | | | | | |
|---|---|---|---|---|---|
| 3,678,693 | A | * | 7/1972 | Markewitz et al. | 249/11 |
| 3,696,177 | A | * | 10/1972 | Holland | 264/32 |
| 3,815,861 | A | * | 6/1974 | Maier | 249/19 |
| 3,897,050 | A | * | 7/1975 | Maloblocki | 269/17 |
| 3,979,919 | A | | 9/1976 | Blonde et al. | |
| 4,261,452 | A | | 4/1981 | Barrows | |
| 4,261,542 | A | * | 4/1981 | Lefebvre | 249/11 |
| 4,439,064 | A | | 3/1984 | van der Gaarden | |
| 4,441,838 | A | * | 4/1984 | Cossart | 405/150.1 |
| 4,463,925 | A | * | 8/1984 | Schimmel | 249/11 |
| 4,465,257 | A | * | 8/1984 | Schimmel | 249/11 |
| 4,930,937 | A | * | 6/1990 | Fulton | 405/149 |

FOREIGN PATENT DOCUMENTS

| | | | |
|---|---|---|---|
| EP | 92 401 605 8 | 10/1992 | |
| FR | 2 256 671 | 12/1963 | |
| FR | 2 239 124 | 7/1973 | |
| FR | 2554154 | * 10/1983 | E04G/11/02 |
| GB | 2008657 | * 11/1978 | E04G/11/02 |

* cited by examiner

*Primary Examiner*—Carl D. Friedman
*Assistant Examiner*—Chi Q Nguyen
(74) *Attorney, Agent, or Firm*—Miles & Stockbridge P.C.; Edward J. Kondracki

(57) ABSTRACT

The invention relates to a tunnel form comprising: two vertical forming walls (2) joined by a horizontal wall (3) in two parts (3A), and at the base of the form, means for adjusting the height of the position of the top edge (5) of the tunnel form relative to the reference surface (6), and means of support (7) at least indirectly with the reference surface so that it can be extracted from the tunnel after production. This tunnel form is characterized in that the aforementioned height adjusting means (4) are supported by props (9), each slide-mounted in a sleeve (10) attached to the base of the tunnel form.

11 Claims, 5 Drawing Sheets

TELESCOPIC TUNNEL FORM

CROSS REFERENCE TO RELATED APPLICATION

The subject matter of the subject invention is related to application Ser. No. 09/853,723 filed on May 14, 2001, in the name of Fabrice PERTOLDI, entitled "TUNNEL FORM", the subject matter of which is incorporated herein in its entirety.

BACKGROUND OF THE INVENTION

1. Field of the Invention

The invention relates to a tunnel form.

It also relates to the utilization of the tunnel form, particularly the method for stripping said tunnel form.

2. Description of Related Art

For the construction of concrete buildings, it is standard to pour the lateral walls at the same time that the upper slab is poured.

The tunnel or tunnels thus produced are then fitted with separating walls that are non-load bearing in order to delimit apartments.

For this purpose, forms known as tunnel forms are used.

This form exists in the form of two vertical forming walls joined at their top parts by a horizontal forming wall so that the assembly forms an upside down U.

A brace maintains the geometry of the form, and adjusting means make it possible to adjust the height of the form and the verticality.

Normally, the vertical forming walls have a height slightly lower than the desired height between the floor and the ceiling, in order to allow stripping.

Extending from a lower slab called a reference surface, in line with the positions of the vertical walls, a kicker of relatively low height, on the order of ten centimeters at most, is produced, making it possible to position the base of the vertical forming walls of the tunnel form and to close the interstice that exists between the base of the vertical forming wall and the reference surface on which the tunnel form rests.

This kicker is produced by placing L-shaped parts at the top part of the tunnel form.

The slight difference between the height of the forming wall and the distance between the floor and the ceiling makes it possible to strip the tunnel and extract it after having acted on the height adjusting means.

Generally, after the form is put in position on both sides of the walls to be produced, concrete is poured in order to fill in the vertical spaces delimited by the forming walls and to form the top slab which, when it solidifies, will constitute the reference surface for a higher floor.

After the concrete of the vertical walls and the top slab are hard enough, the tunnel forms are stripped.

To do this, by acting on the technical elements that maintain the geometry of the upside-down U, the top forming wall is detached from the top slab produced, and also, by acting on the height adjusting means, the top of the tunnel form is lowered by several centimeters and then extracted by being rolled away.

These height adjusting means are limited to an amplitude of a few centimeters.

For some time, architects have maintained the practice of constructing buildings with height differences among the stories and hence having different floor/ceiling heights.

Builders must therefore use tunnel forms wherein the size of the vertical walls is adapted to the height of each story of the building.

This increase in the number of forms obviously creates excess costs, since the forms cannot be used full-time.

Moreover, due to cost concerns, it is not possible to use very many forms of different heights.

There are existing forms that make it possible to adapt the height of the vertical forming wall.

In order to do this, the vertical wall is in two parts, a bottom part of predetermined height and a top part used for the adjustment, and it is this top part to which the horizontal wall is attached.

The set-up/takedown times are prohibitive.

SUMMARY OF THE INVENTION

The object of the invention is specifically to eliminate this drawback.

To this end, the subject of the invention is a tunnel form comprising:

- two vertical forming walls joined by a horizontal wall in two parts assembled with fastening means,
- at the base of the form, means for adjusting the height of the position of the top edge of the tunnel form relative to the reference surface, and means of support at least indirectly with the reference surface so that it can be extracted from the tunnel after the production of said tunnel,
- this form being characterized in that the aforementioned height adjusting means are supported by props, each slide-mounted in a sleeve attached to the base of the tunnel form.

Another subject of the invention is the utilization of the tunnel form, and particularly the method for stripping said tunnel form

BRIEF DESCRIPTION OF THE DRAWINGS

The invention will be clearly understood with the help of the description below, given as a non-limiting example in reference to the attached drawings, which schematically represent.

DETAILED DESCRIPTION OF THE PREFERRED EMBODIMENT(S)

Figure 1:
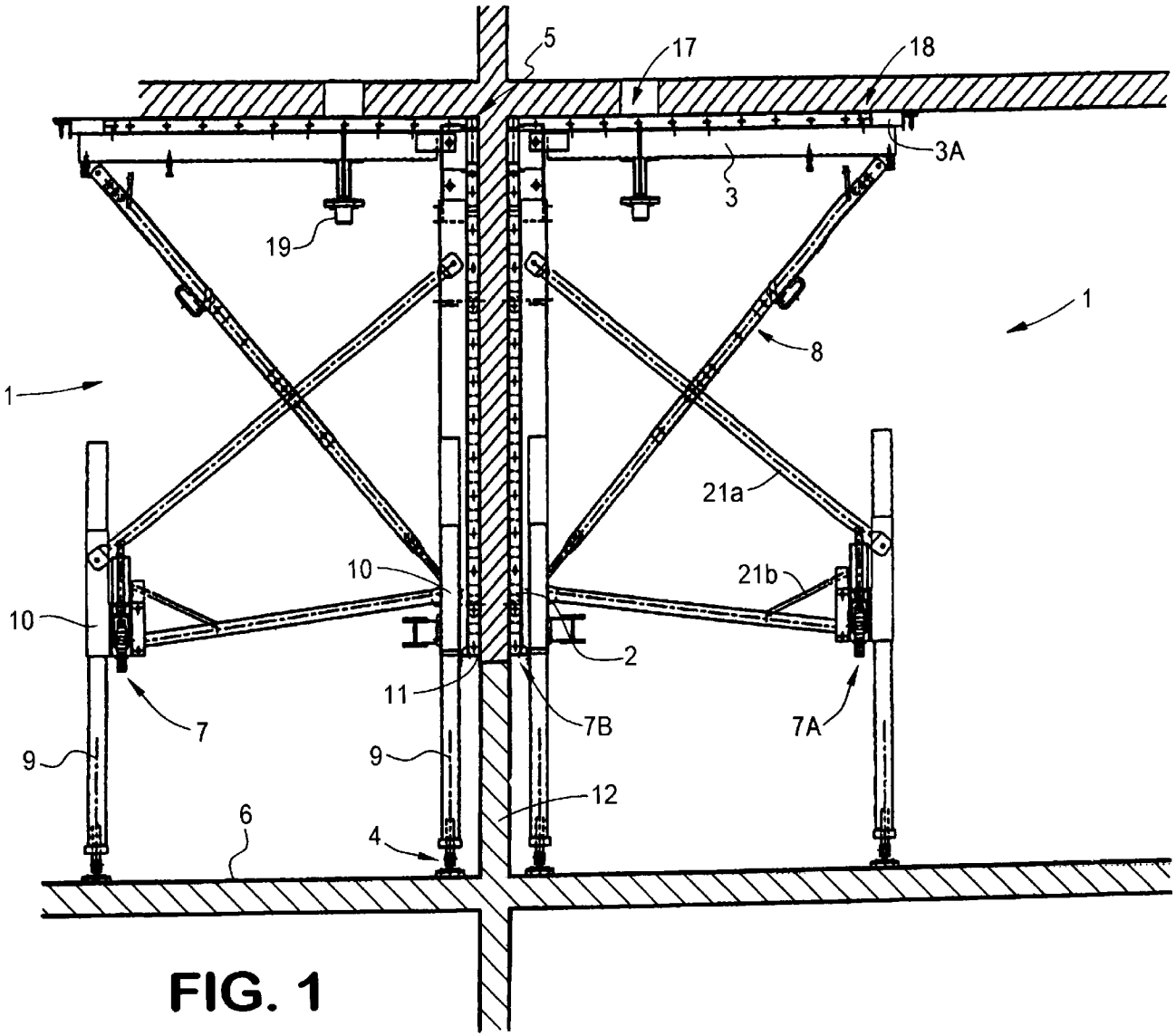
FIG. 1: two tunnel forms according to the present invention.
Figure 2:
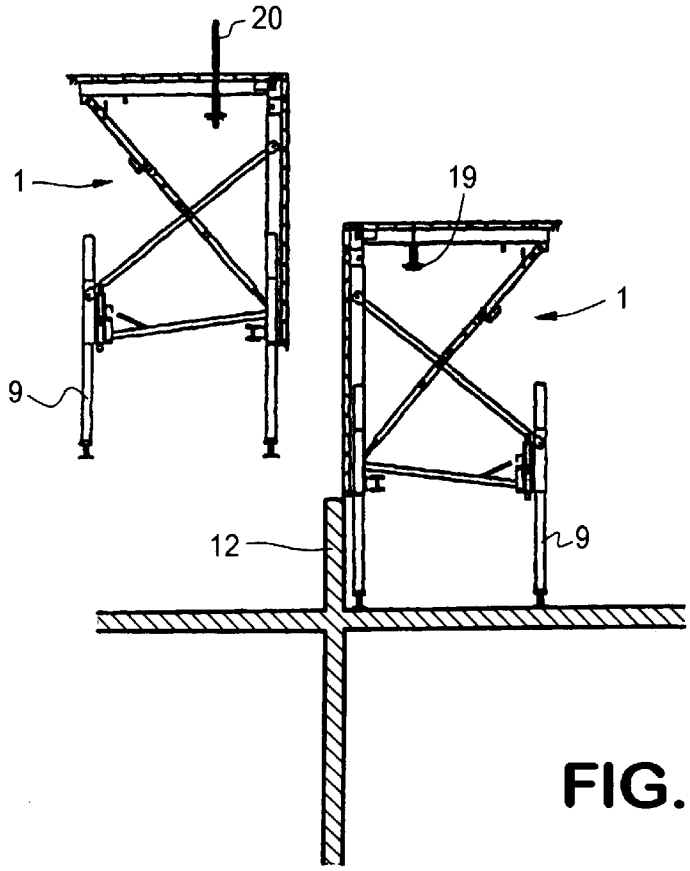
FIG. 2: a tunnel form before positioning and a tunnel form in position.
Figure 3:
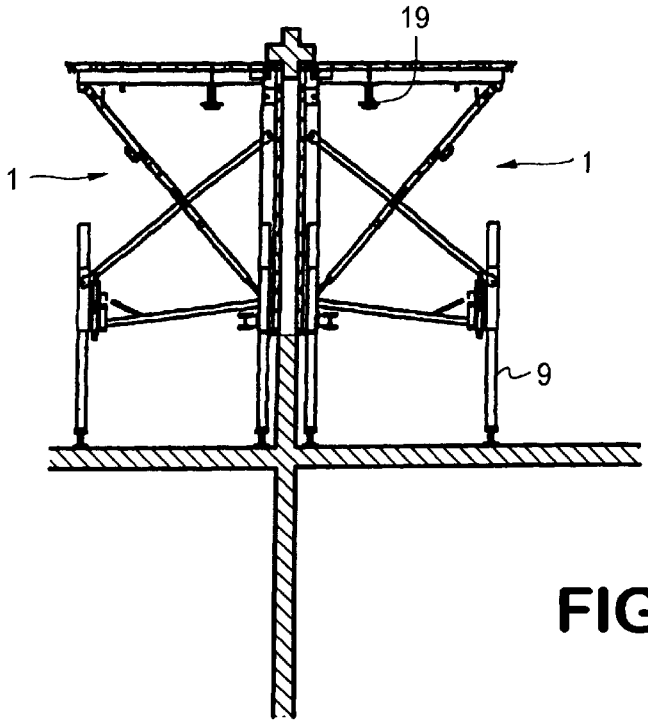
FIG. 3: two tunnel forms in position before concrete is poured.

Referring to the drawings, we see a tunnel form 1.

Only half of a tunnel form is represented.

Conventionally, this tunnel form 1 comprises:

two vertical forming walls 2 joined by a horizontal wall 3 in two parts 3A, at the base of the form, means 4 for adjusting the height of the position of the top edge 5 of the tunnel form relative to the reference surface 6, and means 7 of support at least indirectly with the reference surface so that it can be extracted from the tunnel after production.

These height adjusting means 4 have a relatively small amplitude of adjustment, on the order of ten to twenty centimeters.

A brace 8 mounted on the back of the forming panels makes it possible to adjust the geometry of the upside down U and to support the loads that are exerted on the various forming panels when the concrete is poured. Triangulation elements 21*a* and 21*b* are also shown.

The means 7 of support with the reference surface include wheels 7A or a sliding surface 7B that cooperate with rollers mounted on reference surface 6 during extraction. Support means 7 support the tunnel form after production so that it can be extracted from the formed tunnel.

The form is conventionally extracted by rolling the form in a direction perpendicular to the section defined by the upside down U.

The two parts of the horizontal wall are joined by fastening means (not represented).

These forming walls are constituted by a forming panel reinforced on its rear surface by stiffeners.

According to the invention, the aforementioned height adjusting means 4 are supported by props 9, each slide-mounted in a sleeve 10 attached to the base of the tunnel form.

In the forming position, the height adjusting means 4 are thus far away from the bottom edge 11 of the vertical forming wall and also from the support means 7.

During the utilization of this form, it is necessary to use a kicker 12 that is relatively high and that fills the space between the bottom of the form and the reference surface.

The height of this kicker is, for example, on the order of one hundred to one thousand five hundred millimeters.

This kicker is produced ahead of time.

Props 9 are provided on the back of the vertical forming wall and at the level of the triangulation.

Pins 13 make it possible to position the bottom edge of the form relative to the reference surface at a regular pitch.

Figure 9:
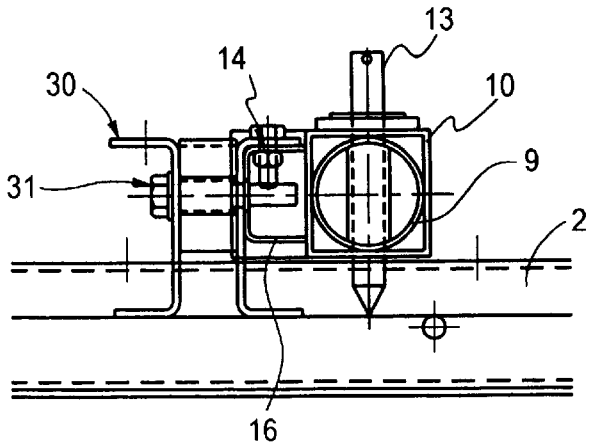
FIG. 9: horizontal sectional view of vertical panel.

These pins therefore pass through both the sleeve 10 and the prop 9, as shown in FIG. 9.

There are means for step-by-step adjustment of the props.

The prop is provided at its base with height adjusting means 4.

Figure 10:
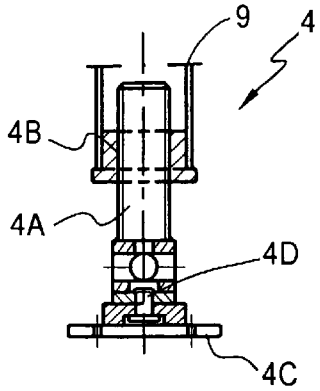
FIG. 10: height adjusting device.

For example, as shown in FIG. 10, this could be bolt 4A that engages with a threading 4B formed in the base of the prop.

This threading is for example borne by a nut installed in the tubular part of the prop.

The base of this bolt 4A is joined to a sole plate 4C by a vertical pin 4D.

The sleeve 10 can be mounted on the form permanently. In an alternative embodiment, it can be attached with removable fastening means 14.

Figure 11:
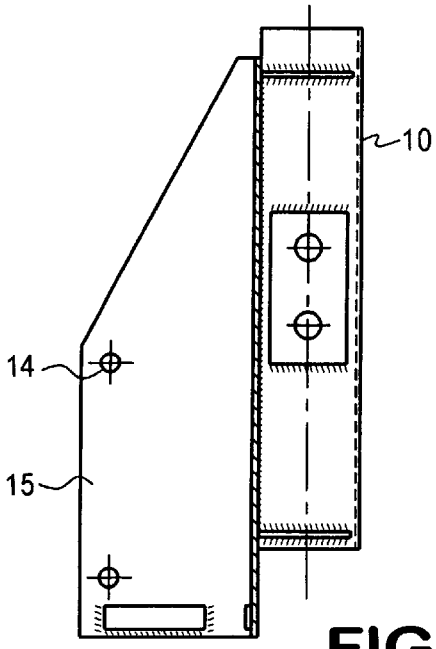
FIG. 11: first view of sleeve.
Figure 12:
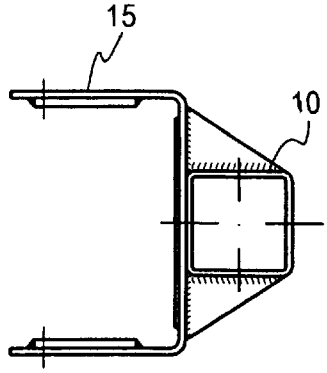
FIG. 12: second view of sleeve.

FIGS. 11 and 12 are views of an embodiment in which sleeve 10 is detachably joined with a triangulation element.

The sleeve is borne by a U-shaped section 15 that covers an element of the triangulation.

Bolts provide the fastening.

FIG. 9 represents the fastening of sleeve 10 mounted on a vertical stiffener 30 of the vertical forming wall.

Bolts 31 maintain the joint with stiffener 30.

Advantageously, for the stripping, the horizontal forming wall has means 19 for attaching at least one sling 20.

When using only one sling, the point of attachment is preferably located along the vertical axis passing through the center of gravity of the form.

Before the concrete is poured, in line with the means for attaching the sling and above these attaching means, a reserved part 17 is provided in the space that will be filled in by the concrete, so that after sufficient hardening of the concrete and shrinking of the reserved part, the sling is inserted through the space retained by the reserved part in the top slab 18 so that it then supports the tunnel form.

Figure 6:
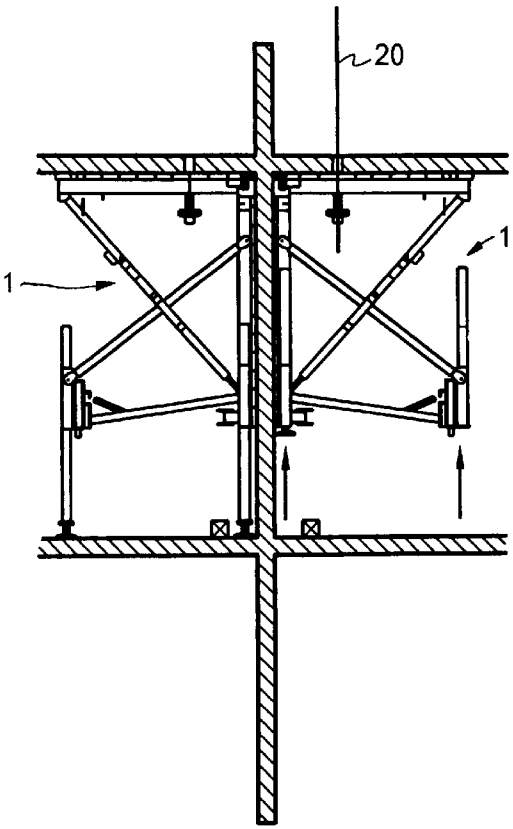
FIG. 6: tunnel form with raised props.
Figure 5:
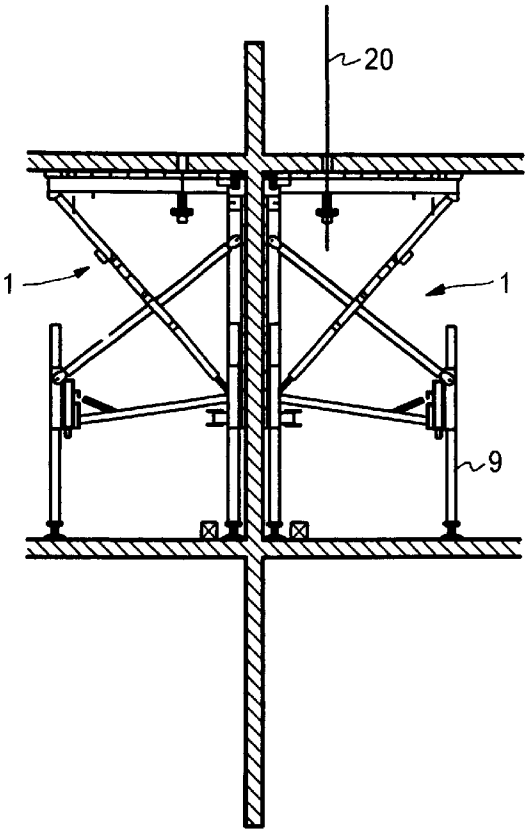
FIG. 5: sling attached to a tunnel form.
Figure 4:
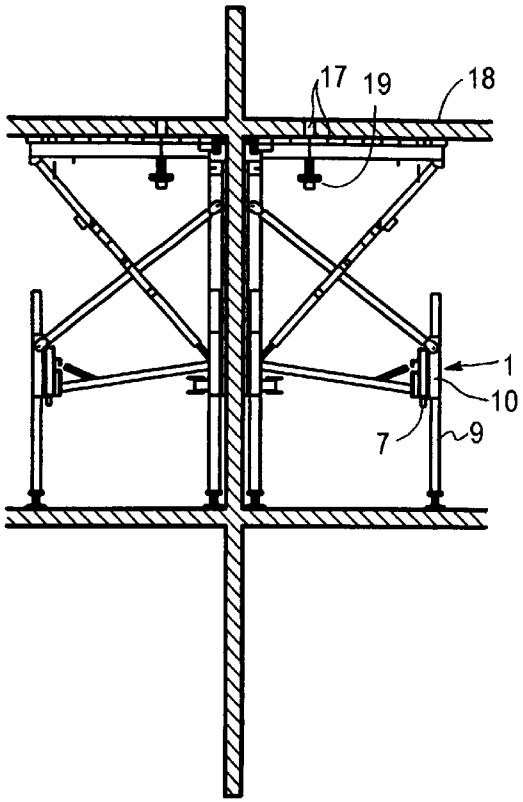
FIG. 4: two tunnel forms in position after concrete is poured.
Figure 7:
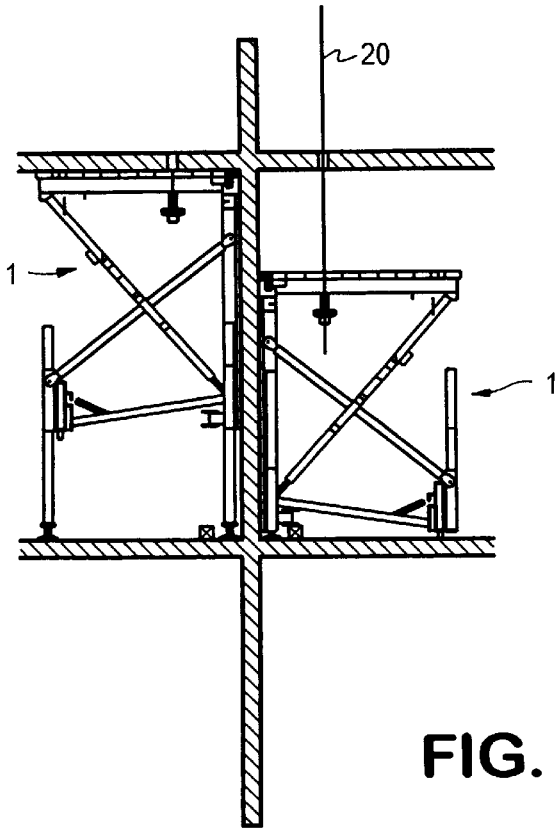
FIG. 7: lowered tunnel form.
Figure 8:
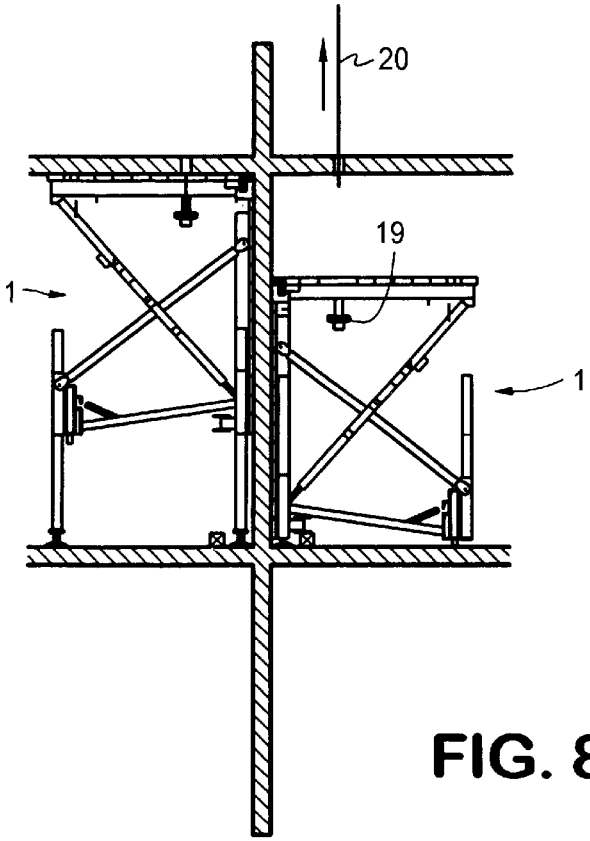
FIG. 8: sling removed from tunnel form.

Thus, for the stripping process:

each part 3A of the horizontal forming wall is tilted, as shown in FIG. 4;

sling 20 is attached to the horizontal forming wall, as shown in FIG. 5;

the form is supported;

the props are raised so that the base of the props is at a level above support means 7, as shown in FIG. 6;

the tunnel form is lowered until support means 7 are in contact with the reference surface, as shown in FIG. 7;

the sling(s) 20 are removed, as shown in FIG. 8; and the form is then moved conventionally by sliding or rolling.

The use of slings attached to a crane prevents the weight of the tunnel form from being supported by the top slab, which has hardened but is not yet capable of supporting a weight greater than its own weight.

The props allow for a rough adjustment, for example every fifteen centimeters, the final adjustment being obtained by means of screw jacks 4.

These props are attached to the tunnel form by removable fastening means such as bolts, so that these props can be easily installed or removed without changing the tunnel base.

The advantage is that it is possible to produce, with the same form, all of a building's stories of normal or non-normal height.

While this invention has been described in conjunction with specific embodiments thereof, it is evident that many alternatives, modifications and variations will be apparent to those skilled in the art. Accordingly, the preferred embodiments of the invention as set forth herein, are intended to be illustrative, not limiting. Various changes may be made without departing from the true spirit and full scope of the invention as set forth herein and defined in the claims.

What is claimed is:

1. A tunnel form comprising:

two vertical forming walls joined by a horizontal forming wall, means for adjusting a height of a top edge of the tunnel form relative to a reference surface, means of support for the tunnel form to said reference surface, said means of support used to support the tunnel form when the tunnel form is stripped from poured concrete, and a prop, wherein said means for adjusting is connected to a base of said prop, said prop being slide mounted in a vertical sleeve attached to a base of said tunnel form;

wherein said prop is placed in a first position when concrete is poured on the tunnel form, and placed in a second position when the tunnel form is stripped from the poured concrete, said base of said prop being lower than the means of support and lower than a base of the vertical forming walls when the prop is in the first position, and said base of said prop being higher than the means of support when the prop is in the second position.

2. A tunnel form according to claim 1, wherein said tunnel form includes at least one triangulation element, and said prop is provided on a back side of said vertical forming wall at a height that is approximately the same as said at least one triangulation element.

3. A tunnel form according to claim 1, wherein:

said means for adjusting is disposed at the base of said prop, said prop having a tubular part and a threading formed in the base of said prop, said means for adjusting comprising a bolt that engages said threading, said threading being borne by a nut in the tubular part of said prop.

4. A tunnel form according to claim 2, wherein:

said means for adjusting is disposed at the base of said prop, said prop having a tubular part and a threading formed in the base of said prop, said means for adjusting comprising a bolt that engages said threading, said threading being borne by a nut in the tubular part of said prop.

5. A tunnel form according to claim 2, wherein said sleeve comprises a U-shaped section that covers a triangulation element.

6. A tunnel form according to claim 1, wherein said prop is joined to the tunnel form by removable fastening means.

7. A tunnel form according to claim 1, wherein said horizontal wall includes means for attaching at least one sling.

8. A tunnel form according to claim 7, wherein if only one sling is used, a point of attachment for said only one sling is located on a vertical axis passing through a center of gravity of the tunnel form.

9. A tunnel form according to claim 1, further comprising means for step-by-step adjustment of said prop.

10. A method of using a tunnel form adapted to have concrete poured on the form, said tunnel form being comprised of two vertical forming walls joined by a horizontal forming wall, said horizontal forming wall having means for attaching at least one sling, means for adjusting a height of a top edge of the tunnel form relative to a reference surface, means of support for the tunnel form to said reference surface, said means of support used to support the tunnel form when the tunnel form is stripped from poured concrete, and a prop, wherein said means for adjusting is connected to a base of said prop, said prop being slide mounted in a vertical sleeve attached to a base of said tunnel form, said method comprising:

providing a reserved part in a space to be filled by concrete in line with said means for attaching at least one sling, said reserved part being located above the attaching means, and inserting at least one sling through said space retained by said reserved part in a top slab of formed concrete so that said at least one sling is capable of supporting at least a part of said tunnel form.

11. A method of using a tunnel form adapted to have concrete poured on the form, said tunnel form being comprised of two vertical forming walls joined by a horizontal forming wall comprised of two parts, said horizontal forming wall having means for attaching at least one sling, means for adjusting a height of a top edge of the tunnel form relative to a reference surface, means of support for the tunnel form to said reference surface, said means of support used to support the tunnel form when the tunnel form is stripped from poured concrete, and a prop, wherein said means for adjusting is connected to a base of said prop, said prop being slide mounted in a vertical sleeve attached to a base of said tunnel form, said method comprising:

tilting each of said two parts of said horizontal forming wall, attaching said at least one sling to said horizontal forming wall, supporting said form, raising said prop so that a base of said prop is at a position higher than the means for support, lowering said tunnel form until said means for support are in contact with a reference surface, removing said at least one sling and moving said tunnel form along the reference surface by sliding or rolling.

* * * * *